United States Patent [19]

Jansson et al.

[11] Patent Number: 4,769,922

[45] Date of Patent: Sep. 13, 1988

[54] METHOD AND MEANS FOR REMOVING LIQUID FROM MOIST METAL PARTICLES

[75] Inventors: Ingmar Jansson, Borgmästarvägen; Ulf Larson, Klockargårdsgatan; Max-Günther Schmidt, Nygårdsvägen, all of Sweden

[73] Assignee: Rutger Larson Konsult AB, Malmo, Sweden

[21] Appl. No.: 922,965

[22] Filed: Oct. 24, 1986

[30] Foreign Application Priority Data

Oct. 28, 1985 [SE] Sweden ..... 8505078-9

[51] Int. Cl.[4] ..... F16B 3/04

[52] U.S. Cl. ..... 34/36; 34/92; 419/30

[58] Field of Search ..... 34/36, 15, 92, 133; 419/30

[56] References Cited

U.S. PATENT DOCUMENTS

| | | | |
|---|---|---|---|
| 2,720,710 | 10/1955 | Erisman | 34/36 |
| 3,121,621 | 2/1964 | Jackson | 34/126 |
| 4,133,635 | 1/1979 | Fellnor et al. | 419/30 |
| 4,141,373 | 2/1979 | Kartanson et al. | 34/92 |
| 4,319,410 | 3/1982 | Heilhecker et al. | 34/92 |
| 4,566,204 | 1/1986 | Freisner | 34/92 |

FOREIGN PATENT DOCUMENTS

| | | | |
|---|---|---|---|
| A10005273 | 11/1979 | European Pat. Off. . | |
| B378901 | 9/1975 | Sweden . | |
| 713009 | 8/1954 | United Kingdom | 419/30 |
| 1575576 | 9/1980 | United Kingdom . | |

OTHER PUBLICATIONS

"Vacuum, Aids Formation of Powder Metallurgical Compacts", Charles Hardy, Steel, pp. 84–85.

Derwent Abstracts No. 38430B/20, Soviet Union 614,297.

*Primary Examiner*—Larry I. Schwartz

*Attorney, Agent, or Firm*—Armstrong, Nikaido, Marmelstein & Kubovcik

[57] ABSTRACT

The invention relates to a method and means for removing liquid from moist metal particles, substantially without causing oxidation, preferably from metal particles produced by means of liquid atomization of a casting jet, wherein the moist metal particles are collected in a space (1) and a non-oxidizing gas flow is blown through them, most of the moisture being caused to accompany the gas flow out of the space (1) and wherein the space, in which the metal particles are filled, is thereafter substantially evacuated so that any remaining liquid is vaporized and thus removed from the space (1).

11 Claims, 2 Drawing Sheets

METHOD AND MEANS FOR REMOVING LIQUID FROM MOIST METAL PARTICLES

Figure 1:
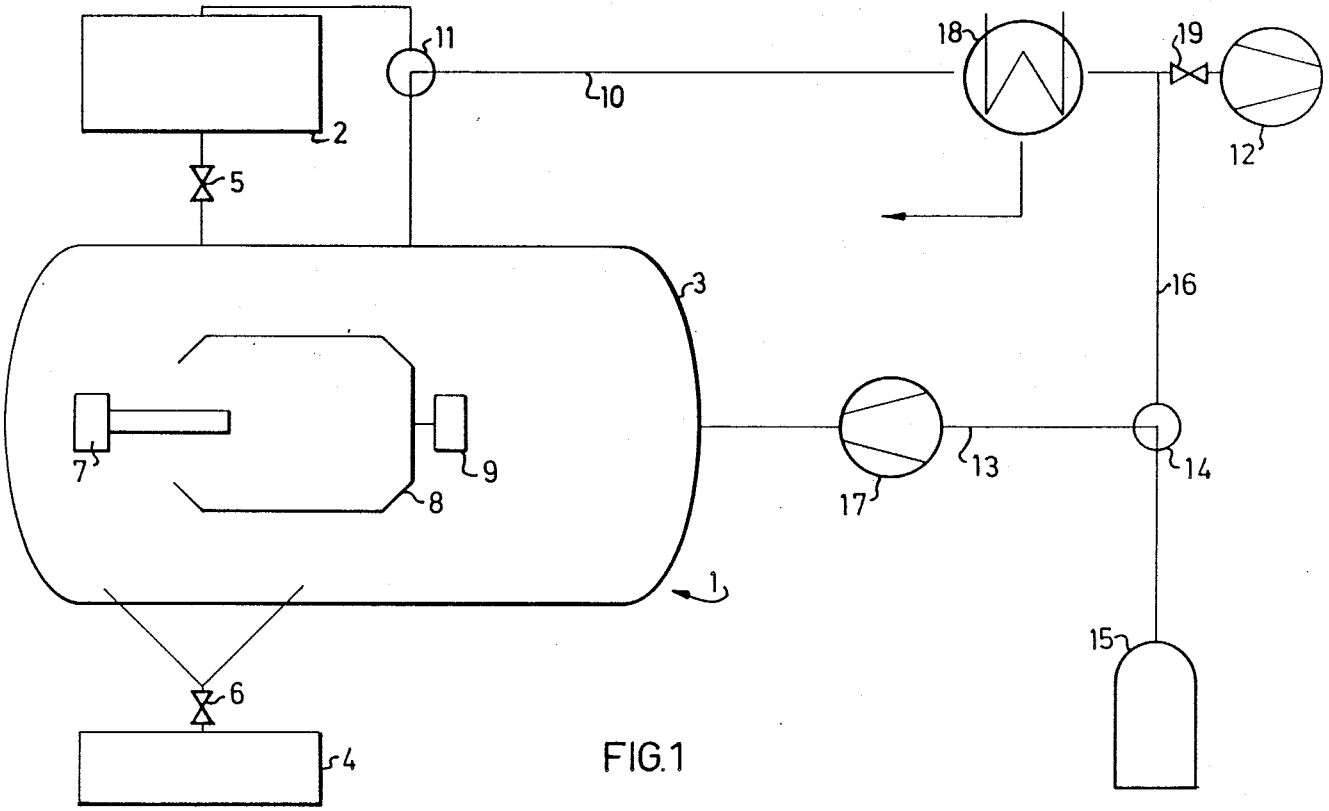

The present invention relates to a method and means for removing liquid from moist metal particles, substantially without causing oxidation, preferably from metal particles produced by means of liquid atomization of a casting jet.

Metal powder is produced by means of liquid atomization in a reaction vessel comprising a granulation chamber with a casting ladle arranged in the upper part. The molten metal is teemed from the casting ladle through a bottom draining hole and is thereafter brought into contact with an atomizing agent expelled at high speed, which disintegrates the casting jet into fine drops. In the case of metal powder in which an extremely low oxygen content is desired, this liquid atomization is performed in a reducing environment and a hydrocarbon compound, preferably paraffin, oil or the like, is used as the atomizing agent. A low oxygen content is required, inter alia, in the production of metal powder for high-alloy tool steel and as starting material in the production of welding electrodes for use when the demands for a strong weld joint are particularly high. This liquid atomizing agent is collected together with the powder formed, in the form of a slurry at the bottom of the reaction vessel.

Conventionally the metal particles and liquid are separated by filtering, centrifuging or similar methods, most of the liquid being removed in a first step and the moist particles then being conveyed to a drying plant. Drying is then effected by hot air flowing through the particles. However, the metal powder is then subjected to undesired oxidation.

A closed system for driving off the liquid has also been proposed. In this case the moist particles are supplied sluice-wise to a motor-driven device which transports the moist particles along a heating arrangement. However, this method has proved far too complicated and since the metal particles must be heated to a relatively high temperature to remove the liquid quickly, the energy requirement is considered too high.

The object of the present invention is to eliminate the above-mentioned difficulties and drawbacks entailed with kown methods of drying moist metal particles, to further reduce the energy required for drying, and to ensure that the metal particles do not become oxidized while the liquid is being driven off.

This is achieved according to the invention in the method described in the introduction substantially in that the moist metal particles are collected in a space and a non-oxidizing gas flow is blown through them, most of the moisture being caused to accompany the gas flow out of the space and in that the metal particles filling the space are thereafter substantially evacuated so that any remaining liquid is vaporized and thus removed from the space.

The metal particles are suitably subjected to heating during removal of the liquid, in order to further promote vaporization of the liquid.

According to a preferred embodiment the gas flow leaving the space is caused to condense by being cooled, the condensed atomization liquid then being collected for re-use.

To perform the method, a means is proposed according to the invention for. removing liquid from moist metal particles, substantially without causing oxidation, preferably from metal particles produced by means of liquid atomization of a casting jet, said means being characterised by a collection space to receive moist particles and means connected to a source for producing a non-oxidizing gas flow through the collection space and also to a vacuum pump for evacuation of the collection space.

The means is preferably provided with a heating means and a condensor to cool the gas flow leaving the space and to condense the atomizing liquid driven off, as well as means for collection and recovery of said liquid. The collection space is preferably provided with an inner drying drum which is rotatable and pivotable, to hold the metal particles, the inner drying drum being pivotable between an upwardly directed filling position, a substantially horizontal operating position, and a downwardly directed feedout position. Fianally, the pipe means may include a circulation fan to effect a circulating gas flow.

Figure 2:
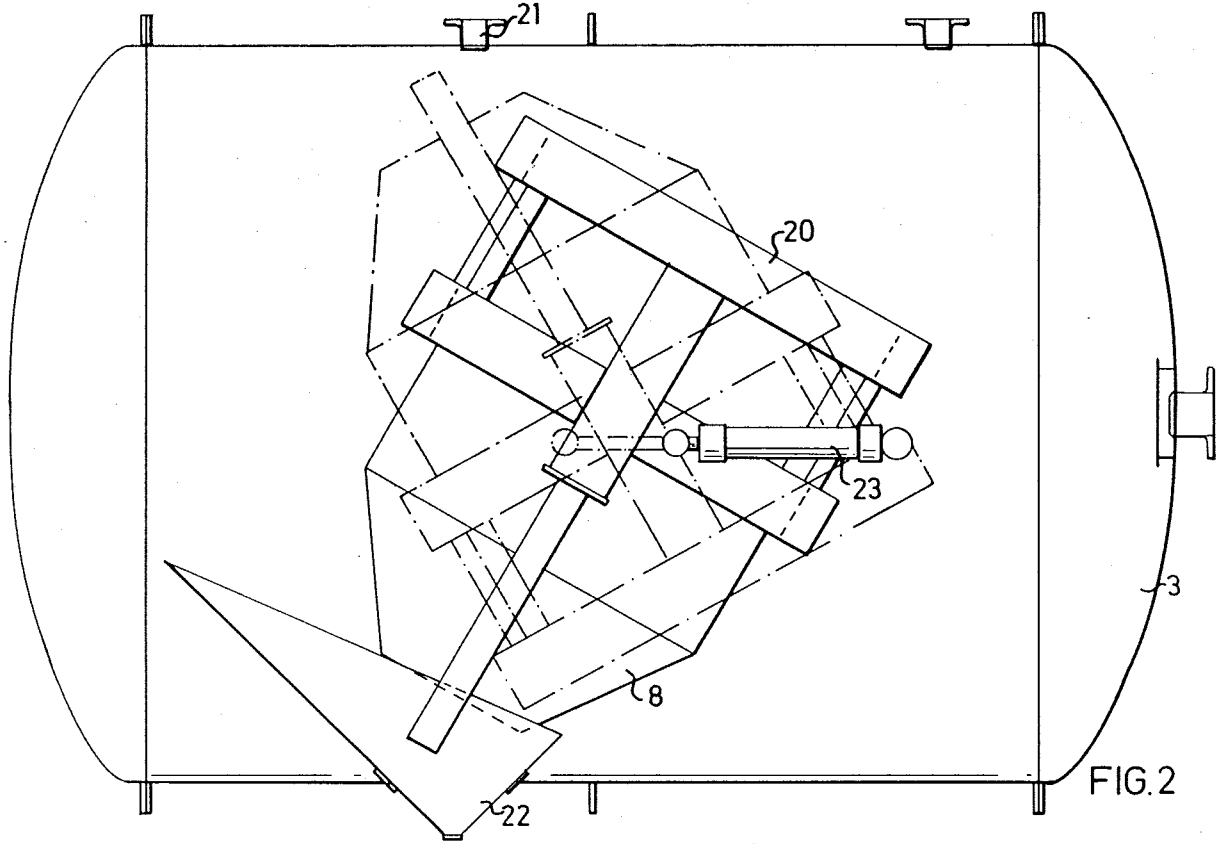

The invention will be described more fully in the following, with reference to the accompanying drawings in which FIG. 1 shows an assembly sketch of a means according to the present invention, FIG. 2 shows, partly in section, a preferred embodiment of a part of the collection space in accordance with the present invention.

FIG. 1 shows a means for removing liquid from metal particles, said means comprising a collection space generally designated 1. In the embodiment shown, the collection space 1 comprises a filling container 2, an autoclave 3 and an emptying container 4, valves 5 and 6 being arranged therebetween. The autoclave 3 is provided with heating means 7 and an inner drying drum 8. This drum can be rotated and pivoted and its movement is driven by a motor 9. An outgoing pipe 10 provided with a valve 11 for connection either to the autoclave vessel 3 or the filling container 2, connects the collection space 1 to a vacuum pump 12. An in-going pipe 13 provided with a valve 14 connects the collection space 1 either to a source 15 to produce a gas or to a pipe 16 for connection with the out-going pipe 10, thus forming a circulation circuit. Said circuit includes a circulation fan 17, preferably arranged in the vicinity of the collection space 1. The out-going pipe 10 also preferably includes a condensor 18 with associated members, as well as another valve 19 in the vicinity of the vacuum pump 12.

FIG. 2 shows the autoclave 3 of the collection space 1, with the inner, rotatable and pivotable drying drum 8. The drying drum 8 is rotatably secured in a stand 20 and the stand 20 with the drying drum 8 is pivotable between an upwardly directed filling position, shown in broken lines in the drawing, for supplying the metal particles through the pipe connection 21, a substantially horizontal operating position, and a downwardly directed feedout position for feeding the metal particles out through a feedout means 22. A hydraulic plunger 23 or the like is provided to effect the pivoting movement.

The method according to the invention for removing liquid from moist metal particles, substantially without causing oxidation, is performed as follows:

The moist metal particles, preferably produced by means of liquid atomization of a casting jet in a reaction vessel, are suitably supplied from this vessel to the collection space 1. At this stage the metal particles from the atomizing process have a liquid content of apporiximately 10%. A non-oxidizing gas, preferably pure nitrogen, i.e. not a product of commercial grade, is then blown through these particles. The liquid, which in this case consists of paraffin, thus accompanies the gas, thus reducing the liquid content in the particles to approximately 2–4%. The collection space is thereafter evacuated, preferably to about 0.05 bar, thus lowering the vaporization temperature of the liquid. Any remaining liquid will therefore be vaporized and removed from the space. This vaporization is additionally promoted by subjecting the particles to heat. Furthermore, after evacuation, remaining gas and vaporized paraffin can be circulated in a circuit including a condensor 18 in which the circulating gas flow is cooled and the vaporized liquid thus caused to condense. The method proposed may be carried out in one step or in a number of steps of alternately blowing nitrogen gas through the particles and then evacuating the collection space.

To perform the method proposed a means is preferably used comprising the collection space 1 for receipt of the moist metal particles. The collection space 1 may consist of the filling container 2, the autoclave vessel 3 and an emptying container 4. The filling container 2 and emptying container 4 are portable, can be hermetically sealed and connected to the autoclave 3. The moist metal particles are thus supplied to the filling container 2 and non-oxidizing gas is blown through either in a separate step or after connected to the autoclave 3. In the latter case the non-oxidizing gas to be blown through the metal particles is conveyed from a source 15 for gas generation, in the form of a gas tube or the like, via the valve 14 and inlet pipe 13 to the autoclave 3. The gas flow is then conveyed via the valve 5 and through the filling container 2, carrying the liquid with it. The gas flow then continues through the valve 11 and out through the out-going pipe 10, via the condensor 18 where the liquid is condensed out, past the valve 19 and vacuum pump 12 to the atmosphere or to a container for recovery. When through-blowing is complete the valve 14 is closed and the drying drum 8 inside the autoclave 3 is turned to an upwardly directed filling position (FIG. 2). Metal particles are transferred from the filling container 2 through pipe connection 21 and into the drying drum 8. The drying drum 8 is then turned by the hydraulic plunger 23 to a substantially horizontal operating position (FIG. 1). Valve 5 is closed and valve 11 connects pipe 10 directly to the autoclave 3. The vacuum pump 12 now evacuates the autoclave 3 and emptying space 4 in the collection space 1, while the drying drum 8 is rotated in the stand 20 by motor 9. Heat is supplied by heating means 7, suitably consisting of an electric element or the like. The liquid is vaporized and conveyed out through outlet pipe 10, condensing in the condensor 18. The condensed liquid is collected and removed for re-use, suitably after purification by means of centrifugal separation to remove any small particles of metal which may have accompanied it. When sufficiently low pressure has been obtained, valve 19 is closed and valve 14 opened to provide communication between supply pipe 13 and pipe 16, thus producing a circulation circuit. A circulation fan 17 is included in the circuit to circulate the remaining gas to take up and transport the vaporized liquid to the condensor 18 where the liquid is removed. This process of driving off the liquid continues until the metal particles are dry. The drying drum 8 is then turned to its downwardly directed, feedout position (FIG. 2) to feed the dry metal particles to the emptying container 4 through feedout means 22. Valve 6 is closed and the emptying container 4 disconnected, allowing the vacuum-packed, dry metal particles to be transported to their destination for use.

The present method and means ensures that the metal particles never come into contact with oxygen in the air and the low oxygen content obtained at liquid-atomization with hydrocarbon can be maintained. Furthermore, this is possible in a process which requires extremely little energy in comparison with drying methods known hitherto.

To further improve the process, the collection container 1 is provided with insulation and an outer heating loop to prevent condensation of the inner walls of the container.

Of course the invention is not limited to the embodiment shown. It can be varied within the scope of the following claims. For example, the construction of the collection space may be varied or it may even be arranged in direct communication with the reaction vessel.

We claim:

1. A method of removing liquid from moist metal particles, substantially without causing oxidation of the metal particles, comprising the steps of collecting metal particles in a space;

blowing a non-oxidizing gas through the moist metal particles to cause most of the moisture to be removed from the space with the gas; and substantially evacuating the space to vaporize the remaining moisture and to remove the vaporized moisture from the space.

2. The method of claim 1 wherein the metal particles have been produced by means of liquid atomization of a casting jet.

3. A method according to claim 1, wherein the metal particles are subjected to heating during removal of the liquid, in order to further promote vaporization of the liquid.

4. A method according to claim 3, wherein the gas flow leaving the space is caused to condense by being cooled, the condensed atomization liquid then being collected for re-use.

5. An apparatus for removing liquid from moist metal particles, substantially without causing oxidation of the metal particles, comprising, a collection space adapted to receive moist metal particles, a source for producing non-oxidizing gas flow through the collection space, a first pipe means connecting the collection space and the source, a vacuum pump, and a second pipe means functionally connecting the collection space and the vacuum pump to allow the evacuation of said collection space.

6. A means according to claim 5, wherein the collection space is provided with a heating means.

7. A means according to claim 6, wherein the pipe means includes a condensor to cool the gas flow leaving the space and to condense the atomizing liquid driven off, as well as means for collection and recovery of said liquid.

8. A means according to any one of claims 6, 7, and 5 wherein the collection space is provided with an inner drying drum which is rotatable and pivotable, to hold the metal particles.

9. A means according to claim 8, wherein the inner drying drum is pivotable between an upwardly directed filling position, a substantially horizontal operating position, and a downwardly directed feedout position.

10. A means according to claim 9, wherein the pipe means include a circulation fan to effect a circulating gas flow.

11. A means according of claim 9, wherein the collection space consists of an autoclave vessel having a portable filling container connectable thereto and an emptying container and valve means arranged therebetween.

* * * * *